US005930796A

United States Patent [19]

Pierce et al.

[11] Patent Number: 5,930,796

[45] Date of Patent: Jul. 27, 1999

[54] METHOD FOR PREVENTING STALE ADDRESSES IN AN IBIP OPEN METERING SYSTEM

[75] Inventors: Perry A Pierce, Darien; Tracy A. Weber, Southbury, both of Conn.

[73] Assignee: Pitney Bowes Inc., Stamford, Conn.

[21] Appl. No.: 08/897,221

[22] Filed: Jul. 21, 1997

[51] Int. Cl.[6] ..... G07B 17/04

[52] U.S. Cl. ..... 707/100; 705/410

[58] Field of Search ..... 707/100, 7; 705/410, 705/408

[56] References Cited

U.S. PATENT DOCUMENTS

| | | | |
|---|---|---|---|
| 4,484,307 | 11/1984 | Quatse et al. | 705/410 |
| 5,726,894 | 3/1998 | Sansone | 705/408 |
| 5,812,401 | 9/1998 | Moore | 705/410 |
| 5,822,739 | 10/1998 | Kara | 705/410 |

*Primary Examiner*—Thomas G. Black
*Assistant Examiner*—Sanjiv Shah
*Attorney, Agent, or Firm*—Charles P. Malandra, Jr.; Melvin J. Scolnick

[57] ABSTRACT

A method to verify the validity of an address to be used in the generation of an indicium by an IBIP open metering system includes entering an address into the metering system; verifying that an address record corresponding to the address exists in an address record database for the metering system; determining from information stored in the address record that the address record is valid; and generating indicium using at least some of said information form the address record and printing said indicium. In determining the freshness of the address record, the method verifies that a postal code exists, that the last cleansing of the address record was later than the last modification of the address record; the validity of a validation field in the address record; and that the time of the last cleansing of the address record is fresh.

8 Claims, 5 Drawing Sheets

FIG . 5

| |
|---|
| ADDRESS (CITY, STREET, ZIP+4, DPBC, ETC.) |
| CLEANSED VERSION |
| TIME AND DATE OF CLEANSING |
| CHECKSUM / SIGNATURE |
| LAST DATE RECORD MODIFIED |
| USER PARAMETERS |

ADDRESS RECORD

METHOD FOR PREVENTING STALE ADDRESSES IN AN IBIP OPEN METERING SYSTEM

FIELD OF THE INVENTION

The present invention relates generally to a method for generating an IBIP indicium and, more particularly, to such method that for preventing the use of stale or invalid addresses when generating an IBIP indicium.

BACKGROUND OF THE INVENTION

The Information-Based Indicia Program (IBIP) is a distributed trusted system proposed by the United States Postal Service (USPS) to retrofit and augment existing postage meters using new technology known as information-based indicia. The program relies on digital signature techniques to produce for each envelope an indicium whose origin cannot be repudiated. IBIP is expected to support new methods of applying postage in addition to, and eventually instead of, the current approach, which typically relies on a postage meter to mechanically print indicia on mailpieces. IBIP requires printing a large, high density, two-dimensional (2-D) bar code on a mailpiece. The 2-D barcode encodes information and is signed with a digital signature.

The USPS has published draft specifications for IBIP. The INFORMATION BASED INDICIA PROGRAM (IBIP) INDICIUM SPECIFICATION, dated Jun. 13, 1996, ("IBIP Indicium Specification") defines the proposed requirements for a new indicium that will be applied to mail being processed using IBIP. The INFORMATION BASED INDICIA PROGRAM POSTAL SECURITY DEVICE SPECIFICATION, dated Jun. 13, 1996, ("IBIP PSD Specification") defines the proposed requirements for a Postal Security Device (PSD) that will provide security services to support the creation of a new "information based" postage postmark or indicium that will be applied to mail being processed using IBIP. The INFORMATION BASED INDICIA PROGRAM HOST SYSTEM SPECIFICATION, dated Oct. 9, 1996, defines the proposed requirements for a host system element of IBIP ("IBIP Host Specification"). The specifications are collectively referred to herein as the "IBIP Specifications". IBIP includes interfacing user (customer), postal and vendor infrastructures which are the system elements of the program.

The user infrastructure, which resides at the user's site, comprises a postage security device (PSD) coupled to a host system. The PSD is a secure processor-based accounting device that dispenses and accounts for postal value stored therein. The host system (Host) may be a personal computer (PC) or a meter-based host processor. As used herein, IBIP open system meter is also referred to as a PC meter.

It is expected that once IBIP is launched, the volume of meters will increase significantly when the PC-based meters are introduced. Such volume increase is expected in the small office and home office (SOHO) market. The IBIP Specifications address and resolve issues which minimize if not eliminate USPS risks regarding security and fraud.

As part of the Host functional requirements for configuration management, section 3.2 of the IBIP Host Specification requires updating the current CD-ROM hosted USPS ZIP+4 National Directory, which typically has a fixed period in which its validity expires. The IBIP Host Specification also requires that the Host vendor inform the users of action necessary to obtain a current version of the current CD-ROM hosted USPS ZIP+4 National Directory and that users have a reliable method to obtain new directories before their current directory expires. The specification further requires that the Host produce standardized addresses, which must include a standard POSTNET delivery point barcode, for use on the mailpieces. Such standardized addresses are used in the generation of indicia evidencing postage in accordance with the IBIP Specifications. The Host must verify each address at the time of mailpiece creation regardless of whether the address had been previously verified.

Thus, IBIP requires that, any time an indicium is to be printed, the address used in the indicium be cleansed, i.e., validated, through an addressing engine that includes the CD-ROM hosted USPS ZIP+4 National Directory. This requirement prevents the printing of an IBIP indicium using a stale or invalid address.

SUMMARY OF THE INVENTION

The present invention provides a method for validating address information which reduces the overhead and burden to a user of an IBIP system by ensuring that a correct DPBC is stored with a record for an address to be printed, and that the record has not been changed or otherwise compromised in any manner. The present invention prevents the use of stale or invalid addresses to print indicium without the need to perform address cleansing every time postage is to be printed. Address cleansing is performed only when it is determined that the address for the indicium is stale or invalid. Using the present invention, PC meter users do not have to interrupt their use of other CD ROM's to insert the CD-ROM hosted USPS ZIP+4 National Directory each time they want to print postage.

The present invention is describe herein as it pertains to the proposed IBIP requirements by the USPS. It will be understood that the present invention is suitable for preventing stale or invalid addresses from being used in the generation of an indicium for any postal coding scheme allowed by the USPS. For example, if the USPS permits postal coding by modem or over the internet as an alternate means, i.e. other than the CD-ROM hosted USPS ZIP+4 National Directory, the present invention avoids the need for a user to access such dial-up or internet service every time an indicium is being generated.

In accordance with the present invention, when a user wants to print an address with an IBIP product, an algorithm in the IBIP metering application is run against every requested address to be printed to determine if it has been properly cleansed and valid, i.e., not stale. If the algorithm determines that the address is valid, postage can be printed without concern as to whether or not the address is stale. If the application determines that the addresses in the current selection are acceptable for printing, postage can be deducted from the PSD and the address printed on the envelope. Should there be addresses that fail such checks, the user can be presented with options to clean their address now, or clean them later. If the user selects clean now, the address is cleansed and the envelope can be printed with indicium generated from the cleansed address. If the user selects later, the envelope can still be printed but without an indicium.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which:

FIG. 5 is a block diagram of an address record;

DETAILED DESCRIPTION OF THE PRESENT INVENTION

Figure 1:
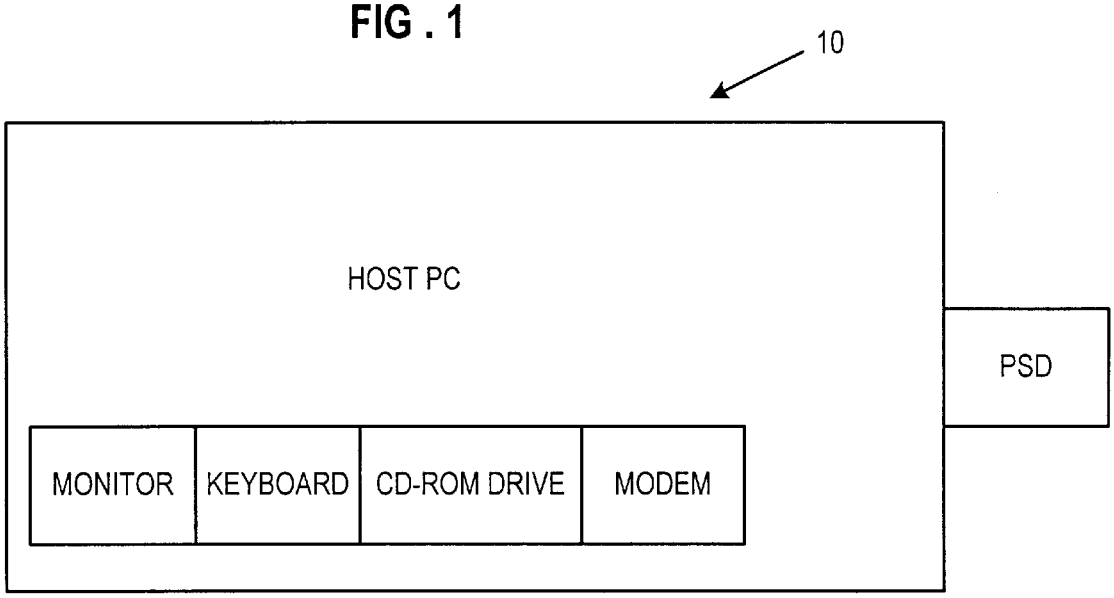
FIG. 1 is a block diagram of a PC meter in which the present invention runs.

In describing the present invention, reference is made to the drawings, wherein there is seen in FIG. 1 a PC meter, generally designated 10, configured in accordance with the IBIP Specifications.

PC Meter 10 includes a conventional personal computer, including monitor, keyboard, printer, CD-ROM drive, modem, conventional operating system and application software. PC meter 10 also includes a PSD, which is the postal security hardware device that attaches to a user's PC in accordance with the IBIP Specifications. Finally, PC meter 10 includes a metering application software and a CD-ROM hosted USPS ZIP+4 National Directory. The basic function of the PC Meter is to print postage on envelopes or labels at the same time the address is printed using a standard PC and an off-the-shelf PC printer. In addition to printing postage on envelopes, the PC Meter software includes features that interactively examine and correct mailing addresses, design the printing to be done on the surface of an envelope or label, and manage address lists for small mailing applications, such as, invoicing or follow-up letters. The PC Meter software provides additional convenience by allowing the user to print postage directly from existing PC software packages, such as, word processors, contact management software, or accounting packages.

As used herein, the term "postal coded", also referred to herein as address verification, means the generation of a delivery point bar code (DPBC). In accordance with the IBIP Specifications, each time an envelope is printed with a postal indicia, the address used in generating the indicia must be postal coded. IBIP requires this stringent and redundant task to prevent a user from manipulating addressing data outside of a PC metering application or even inside the application so that a DPBC may be present in the hard drive of the PC from prior envelopes, but not valid. The present invention provides a process that determines whether a previously postal coded address is still valid which eliminates the need to postal code every time an indicium is generated. The present invention makes such determination based on data that was stored with the address when the address was postal coded or when the address was changed or updated.

The following description will be for a single address; however, those skilled in the art will understand that the following steps may be performed for a batch of addresses.

Figure 2:
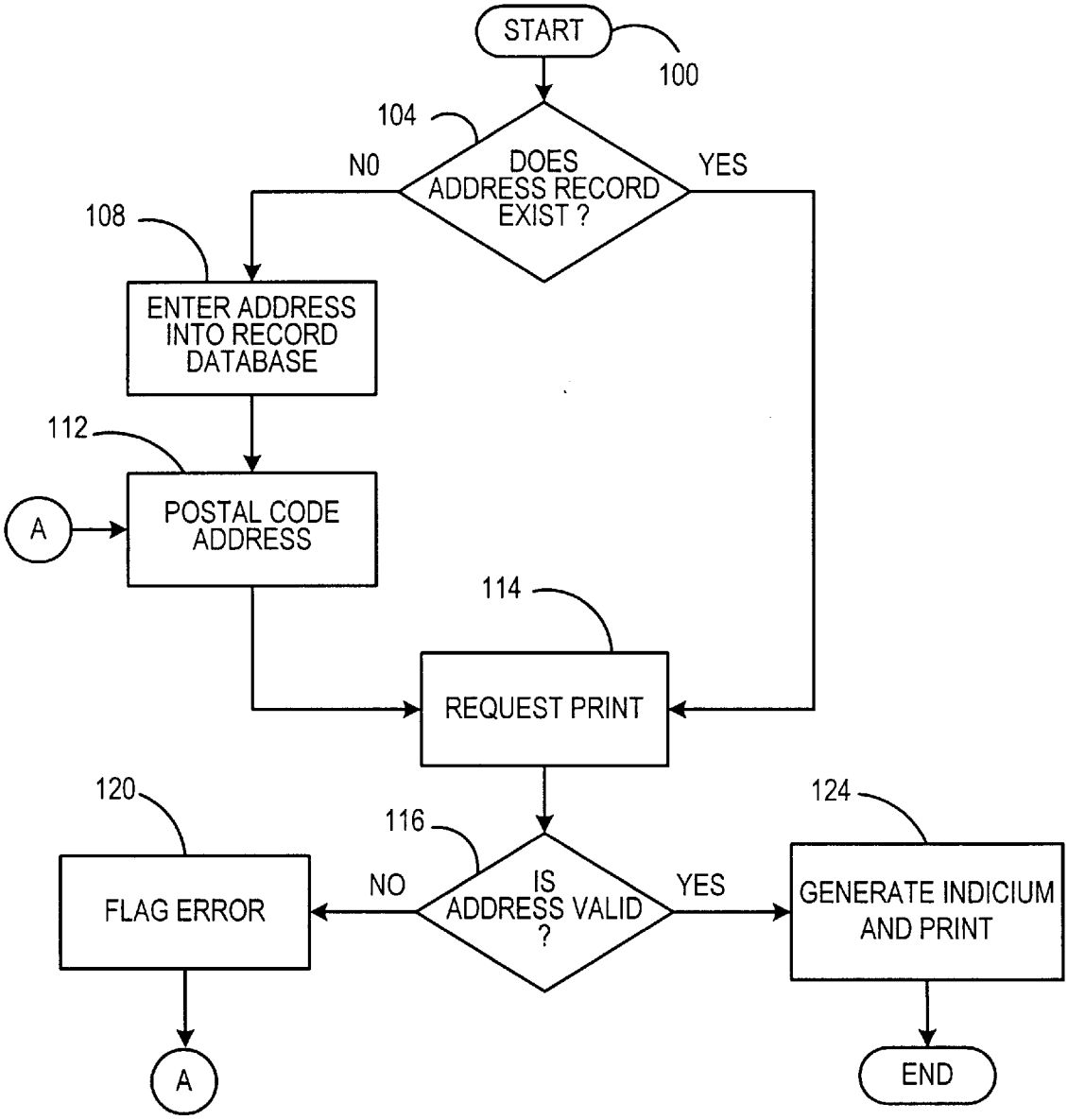
FIG. 2 is a flow chart of the process for printing an envelope in accordance with the present invention.
Figure 3:
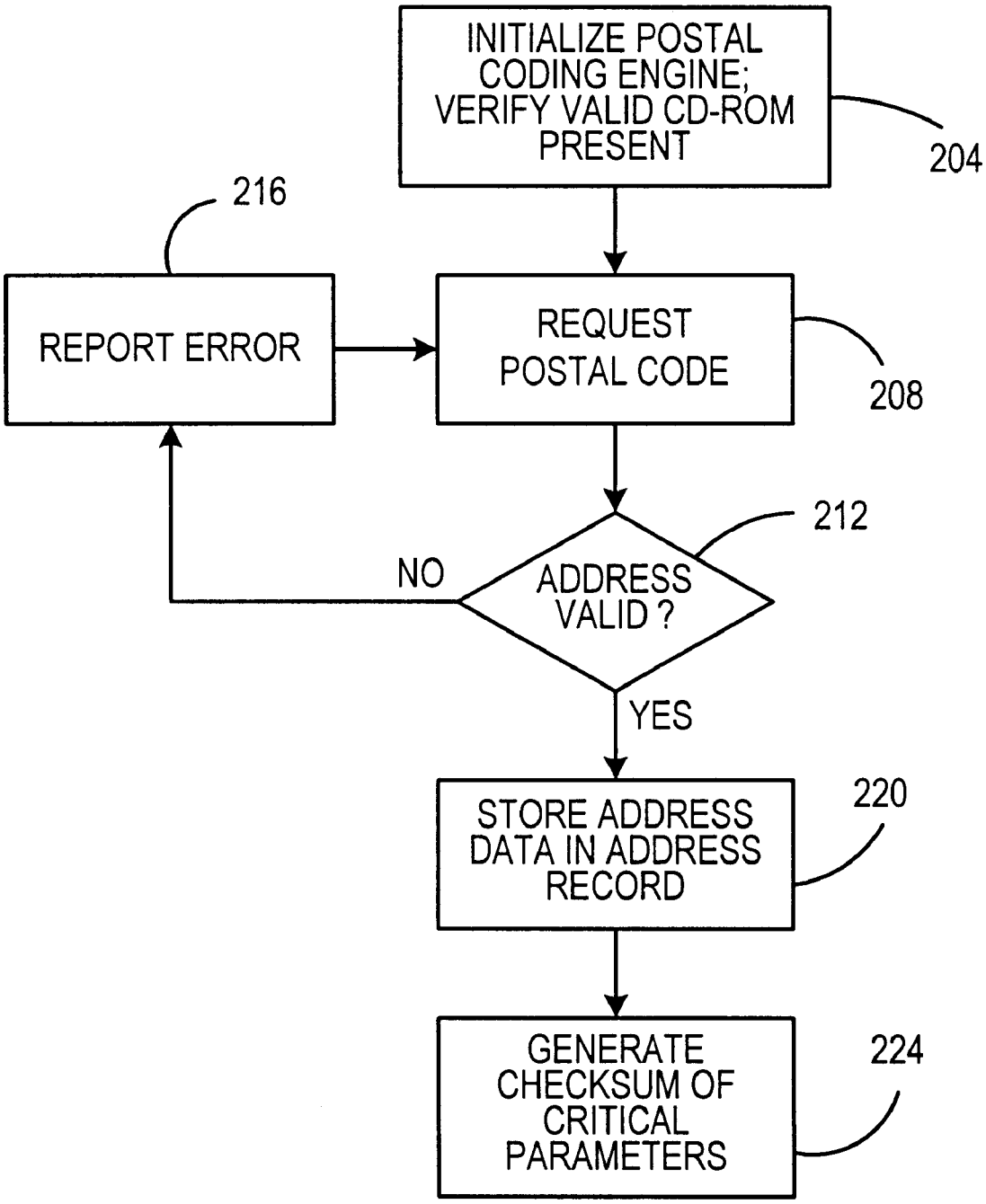
FIG. 3 is a flow chart of the step of postal coding and address in the process of FIG. 2.

Referring now to FIG. 2, the method of printing envelopes in accordance with the present invention is shown. At step 100, a user initiates a print envelope routine. At step 104, the system checks whether an address record exists for the mailing address of the envelope. If a record does not exist, then at step 108, the system enters the address into an address record in the record database. At step 112, the system postal codes the address (described in detail for FIG. 3 below) and stores the postal code in the address record. Once it is determined that an address record exists for the address, either at step 104 or from step 112, then, at step 114, the system processes the user print request. At step 116, a determination is made that the address record is valid, i.e., is not stale and has not been tampered with since it was last postal coded. The validation or verification process is described below for FIG. 4. If valid, at step 124, the indicium is generated and then printed. If not valid, then at step 120, an error is flagged and the system returns to step 112 to postal code the address. Referring now to FIG. 3, the process of postal coding an address and storing it in the database is shown. At step 204, a postal coding engine is initialized and verifies a CD-ROM hosted USPS ZIP+4 National Directory is present and valid for the current system date. The CD-ROM is needed to assign addresses with valid DPBC's. At step 208, a PC meter (or other) application program sends address data to the postal coding engine and requests DPBC assignment. At step 212, a check is made to determine if the address is valid using the CD-ROM hosted USPS ZIP+4 National Directory. If the address is not valid, then at step 216, an error is reported indicating, for example, not finding address in the CD-ROM hosted USPS ZIP+4 National Directory, and the user is prompted to correct the address. When this address has been corrected, the address is now cleansed and the process returns to step 208. If the address was valid at step 212, then, at step 220, valid address data is stored in a corresponding address record in the record database including the DPBC assignment and other fields that are used to determine address freshness during print process, such as version of ZIP+4 National Directory and time of cleansing. At step 224, a checksum or digital signature of the critical parameters of the address record, i.e., parameters effecting the validity of the address record, is generated and stored it in a field of the address record. In the preferred embodiment, of the present invention, such critical parameters include at least the postal data, i.e., mailing address, date the record was last modified, version of cleansing CD-ROM and the time of last cleansing of the address. It will be understood that any other fields up to and including the entire address record can be treated as critical parameters. By generating a checksum or signature of only critical parameters in the address record allows users to modify other fields without having to recleanse the address record.

In addition to a checksum or arithmetic redundancy check (ARC) on the critical parameters of the address record or digitally signing such critical parameters, other methods for validating the address records include a cyclic redundancy check (CRC) on such critical parameters and hashing of such critical parameters of the address.

If the user changes any of the address record critical parameters through the PC meter application, the PC meter application updates the last modified date of the record and checksum, which are also one of the critical parameters. The next request to print the address will flag an error and prompt the user to cleanse the address. In accordance with the present invention, the system will not print the address or generate an indicium for the address if the address has not been cleansed or validated. If changes to any critical parameter are made from other than the PC meter application, such as through a database, then the checksum or digital signature will not validate when a request print is made.

Figure 4:
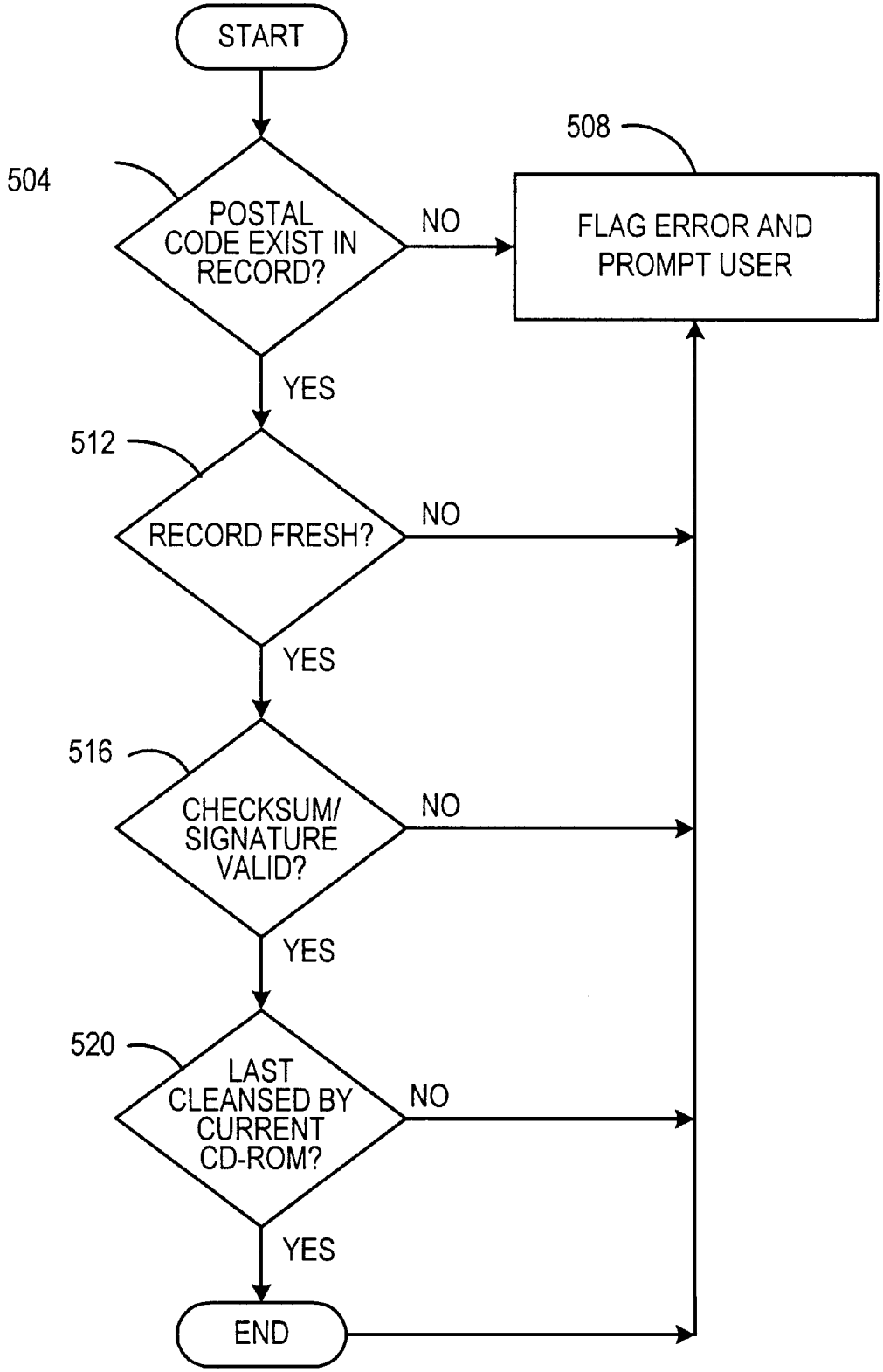
FIG. 4 is a flow chart of the step of validating an address record in the process of FIG. 2.

Referring now to FIG. 4, the validation, i.e., verification, of the address record is shown, which corresponds to Step 116 in FIG. 2. At step 504, the process determines whether a DPBC exists in an address record, which indicates that the address was postal coded using a ZIP+4 National Directory. If one does not exist, then, at step 508, an error is flagged and the user is prompted to postal code the address. If a DPBC does exist, then, at step 512, the process validates that Last Cleansed Date of the address record is later than the Last Record Modification Date. In this manner, if any critical parameters have been changed since the last time the record was cleansed an error will be flagged. At step 516, the process checks if the checksum or digital signature is valid for the address record. If not valid, then, at step 508, an error is flagged and the user is prompted to postal code the address. If valid, then at step 520, the process determines if the cleansed date and time are within a time frame of fresh data for the CD-ROM in use. If not within the time frame, then, at step 508, an error is flagged and the user is prompted to postal code the address. This time frame typically is base on fixed rules but may be obtained from the CD-ROM itself. If within the time frame, but a configuration database indicates that a newer CD-ROM should have been received by the user as described below, the address is considered stale.

In addition to including the identification of the latest version of the CD-ROM, the configuration database can optionally include software versions of all host system components, supporting files and any other IBIP required deadlines. This database is updated every time a new CD ROM is seen or the vendor infrastructure indicates to the PC meter that a new one should have been received by the customer.

In operation, when the user requests the PC meter to print addresses with postage, the application supplying addresses indicium generation will scan the selected addresses to ensure that they are not stale. In addition to addressing data fields, the address records contain the following additional information: last address cleansing date, last record modification date, record checksum or digital signature and CD-ROM version used to cleanse the address. The application will also need to contain a database of the current version of the CD-ROM. This database is a requirement for the host in an IBIP open system.

The following is a detail of the algorithm used to verify address freshness. It is noted that the steps of the algorithm can be performed in any order.

1. Validate that a delivery point barcode has already been assigned, or fail the record.

2. Validate checksum or record signature to verify that the record was not modified by the user in an offline mode. If not verified fail the record.

3. The last modification date is no later than the last cleansing date of the address record, or fail the record.

4. The configuration database indicates no newer CD ROM is available when compared against the CD-ROM version field of the address record, if newer see step 4.

5. If the configuration database indicates a newer CD-ROM is available and is present in the CD-ROM drive, cleanse the address to verify that it is still a valid address, if newer CD-ROM is not available fail the record. If address is still valid, update address record with new CD-ROM version, last cleansed date and checksum.

While the present invention has been disclosed and described with reference to a single embodiment thereof, it will be apparent, as noted above, that variations and modifications may be made therein. It is, thus, intended in the following claims to cover each variation and modification that falls within the true spirit and scope of the present invention.

What is claimed is:

1. A method to verify the validity of an address to be used in the generation of an indicium by an IBIP open metering system, the method comprising the steps of:

entering an address into the metering system;

verifying that an address record corresponding to the address exists in an address record database for the metering system;

determining from information stored in the address record that the address record is valid; and generating indicium using at least some of said information from the address record and printing said indicium;

wherein the address record includes a postal code, time the address record was last cleansed, latest version of the addressing database used to cleanse the address record, and one of a checksum, digital signature, CRC and hash of critical parameters of the address record.

2. The method of claim 1 wherein the step of determining that an address record corresponding to the address exists comprises the step of:

verifying that a postal code has already been assigned to the address record;

postal coding the address when a postal code has not been assigned; and storing the postal code in the address record.

3. The method of clam 1, wherein the step of determining the information is valid comprises the step of:

verifying that the postal code exists;

verifying that the last cleansing of the address record was later than the last modification of the address record;

verifying the validity of a validation field in the address record; and verifying that the time of the last cleansing of the address record is fresh.

4. The method of claim 3 wherein the validation field contains a checksum of critical parameters in the address record.

5. The method of claim 3 wherein the validation field contains a digital signature of at least some of the information in the address record.

6. A method for verifying address freshness in an IBIP open metering system, the method comprising the steps of:

verifying that a delivery point barcode has already been assigned to an address and stored in an address record corresponding to the address;

verifying the validity of a validation field in the address record to confirm that the record was not modified by the user in an offline mode;

verifying the time that the address record was last modified is earlier than the last cleansing date of the address record; and verifying the address record was last cleansed using the latest approved addressing database.

7. The method of claim 6 wherein the validation field contains a checksum of critical parameters in the address record.

8. The method of claim 6 wherein the validation field contains a digital signature of at least some of the information in the address record.

* * * * *